US006712439B1

(12) United States Patent
Anderson et al.

(10) Patent No.: US 6,712,439 B1
(45) Date of Patent: Mar. 30, 2004

(54) INTEGRATED CIRCUIT AND DRIVE SCHEME FOR AN INKJET PRINTHEAD

(75) Inventors: Frank Edward Anderson, Sadieville, KY (US); George Keith Parish, Winchester, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/321,038

(22) Filed: Dec. 17, 2002

(51) Int. Cl.[7] ..... B41J 29/38; B41J 2/05
(52) U.S. Cl. ..... 347/12; 347/58
(58) Field of Search ..... 347/12, 15, 48

(56) References Cited

U.S. PATENT DOCUMENTS

| | | | | |
|---|---|---|---|---|
| 4,169,684 A | | 10/1979 | Blom | |
| 5,210,822 A | | 5/1993 | Tsuchiya et al. | |
| 5,265,315 A | | 11/1993 | Hoisington et al. | |
| 5,537,223 A | | 7/1996 | Curry | |
| 5,541,629 A | | 7/1996 | Saunders et al. | |
| 5,594,478 A | | 1/1997 | Matsubara et al. | |
| 5,644,342 A | | 7/1997 | Argyres | |
| 5,790,140 A | | 8/1998 | Koizumi et al. | |
| 6,299,284 B1 | | 10/2001 | Alfaro | |
| 6,431,677 B1 | * | 8/2002 | Anderson et al. | 347/12 |
| 6,565,175 B1 | * | 5/2003 | Scardovi et al. | 347/12 |
| 6,582,042 B1 | * | 6/2003 | Torgerson et al. | 347/12 |

FOREIGN PATENT DOCUMENTS

| | | |
|---|---|---|
| EP | 0 618 075 B1 | 12/1997 |
| EP | 0 837 424 A2 | 4/1998 |

* cited by examiner

*Primary Examiner*—Stephen D. Meier
*Assistant Examiner*—Alfred Dudding

(57) ABSTRACT

An integrated circuit in an ink jet printhead selectively activates one or more printing elements on the printhead based on a multi-dimensional addressing scheme. The integrated circuit includes a plurality of pass switching, power switching, and one or more ground switching devices for selectively connecting one or more power switching devices to ground to activate one or more of the printing elements to print an image on a print medium. The integrated circuit includes a number of first, second, third, and fourth control lines for selectively controlling the activation of one or more of the printing elements.

20 Claims, 5 Drawing Sheets

INTEGRATED CIRCUIT AND DRIVE SCHEME FOR AN INKJET PRINTHEAD

FIELD OF THE INVENTION

The present invention is generally directed to inkjet printers. More particularly, the invention is directed to an integrated circuit for an ink jet printhead for selectively addressing and activating printing elements according to a multi-dimensional addressing scheme.

BACKGROUND AND SUMMARY OF THE INVENTION

Hardware and software limitations constrain current inkjet printers. For example, the number of available inputs and outputs limit the operation of an inkjet printhead's integrated circuitry to effectuate a printing operation to print an image onto a print medium. The printhead's integrated circuit limitations have a corresponding limiting effect on overall printing operations. Thus, there is a need for inkjet printers and printing techniques which overcome these drawbacks and limitations.

The foregoing and other needs are met by an improved printhead drive scheme for activating printing elements on a printhead of an ink jet printer. In one aspect of the invention, providing first, second, third, and fourth control signals to a printhead control circuit activates one or more firing resistors, herein termed heaters, thereby energizing adjacently disposed ink to print an image on a print medium.

Providing an additional ground switching device, such as a field effect transistor, in the printhead control circuit that electrically connects each source of each power transistor to a drain of a ground switching device provides an additional dimension for the printer to address inkjet printhead nozzles. Activating one or more ground switching devices connects one or more corresponding heaters to ground.

Thus, the invention provides an additional dimension for addressing a printhead. A one for one match is not required between the one or more ground switching devices and the resistive heaters. For example, two or more of the heaters could be connected in parallel to each other, and the parallel heaters could be connected in series with one of the ground switching devices.

In another aspect, the addition of the ground switching devices allows a fixed voltage rail on the high sides of the heaters. A fixed voltage rail allows printer driver simplification, the driver providing the switching to the high side of the heaters for each fire while maintaining a reduced input/output architecture.

One advantage of the invention is that the additional addressing dimension may be used to prevent the firing of all heaters of the printhead. This "chip-select" feature allows sharing the other address lines between different printheads, monochrome and color for example, using the additional addressing dimension to determine which printhead is printing.

A method is disclosed for activating a printing element within an array of printing elements on a printhead of an inkjet printer. The printhead includes a plurality of printing elements, power switching devices, pass switching devices, and one or more ground switching devices. A plurality of subsets of printing elements and associated pass switching devices are defined within a plurality of groups of printing elements and associated pass switching and power switching devices. The method provides a subset selection signal to the pass switching devices and power switching devices of a selected one of the subsets to thereby select a subset of printing elements in the array of printing elements based on the subset selection signal.

An address signal is provided to a selected subset of the pass switching devices to thereby select one or more printing elements based on the address signal, and a heater select signal is provided to one or more of the ground switching devices. The method also provides a primitive signal to a select one of the groups of printing elements on the printhead, and activates a selected printing element within the select group based on the primitive signal and the heater select signal.

An integrated circuit is provided for use in an ink jet printer having a printer controller for generating print signals and a printhead for generating a printed image on a print medium. The integrated circuit includes a plurality of printing elements arranged in selectable groups for printing the image on the print medium. The circuit includes a plurality of power switching devices, each coupled to a corresponding one of the printing elements, a plurality of pass switching devices, each coupled to a corresponding one of the power switching devices, and one or more ground switching devices coupled to one or more of the power switching devices.

The circuit has p number of first control lines, each coupled to a corresponding one of the selectable groups of printing elements. Each first control line provides the first control signal to one or more of the selectable groups of printing elements, thereby selectively enabling activation of one or more of the selectable groups of the printing elements. The circuit has q number of second control lines, each coupled to a corresponding selectable subset of power switching devices and pass switching devices within one or more of the selectable groups of printing elements. Each second control line provides the second control signal to the corresponding selectable subset of power switching devices and pass switching devices, the second control lines for selectively enabling activation of the corresponding subset of power switching devices and pass switching devices within the one or more selectable groups.

The circuit also includes a number of third control lines, each coupled to corresponding pass switching devices within each subset of printing elements. The third control lines provide the third control signal to the corresponding selectable subset of pass switching devices, the third control signal for selectively enabling activation of one of the printing elements within the corresponding selectable subset. H number of fourth control lines are coupled to the one or more of the ground switching devices. The fourth control lines provide the fourth control signal to the one or more ground switching devices, selectively activating the one or more of the ground switching devices to connect the one or more power switching devices to ground, and thereby activating a selected printing element within the selected subset of printing elements.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF THE INVENTION

Figure 1:
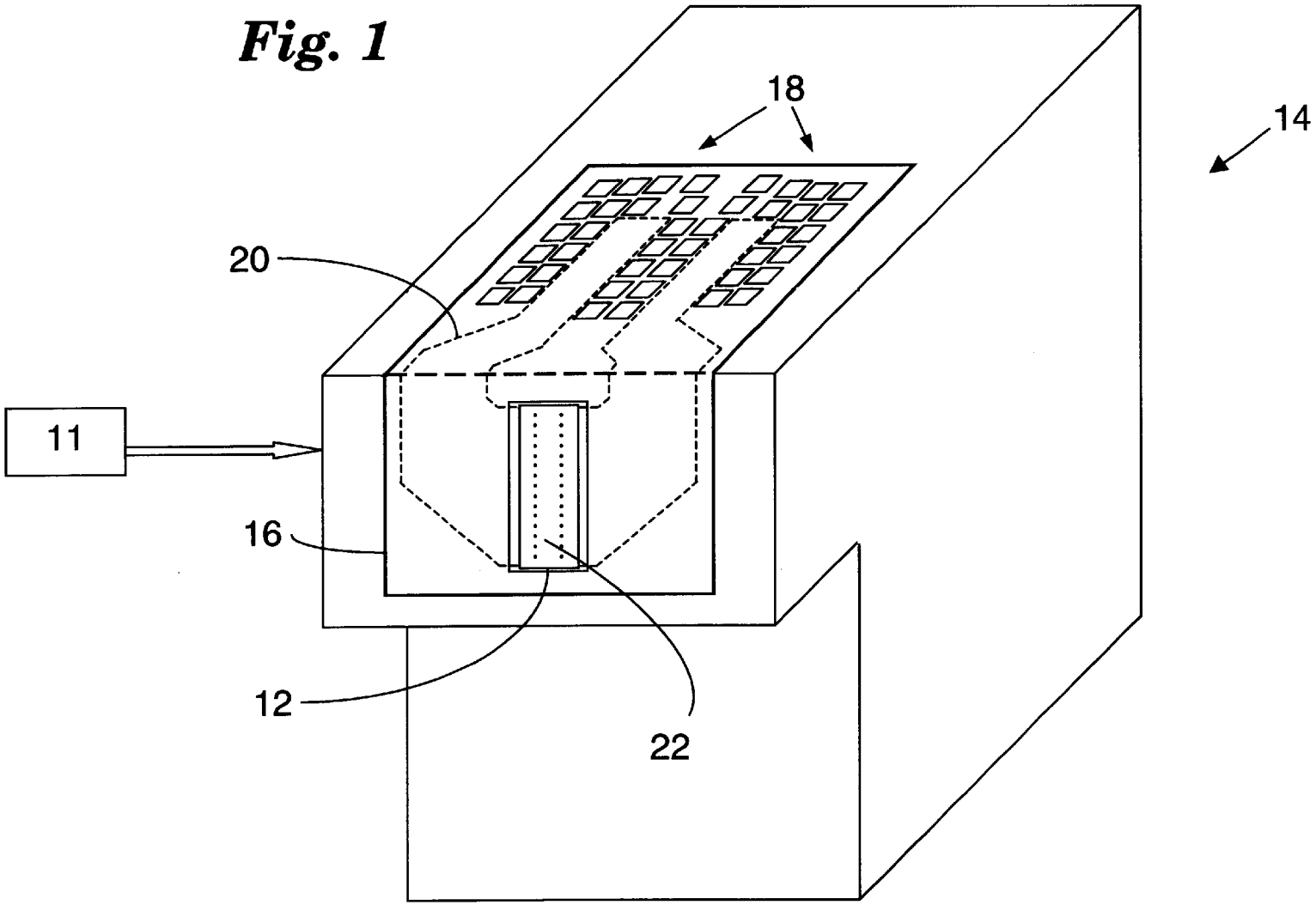
FIG. 1 depicts a preferred embodiment of a printhead for an inkjet printer.
Figure 2:
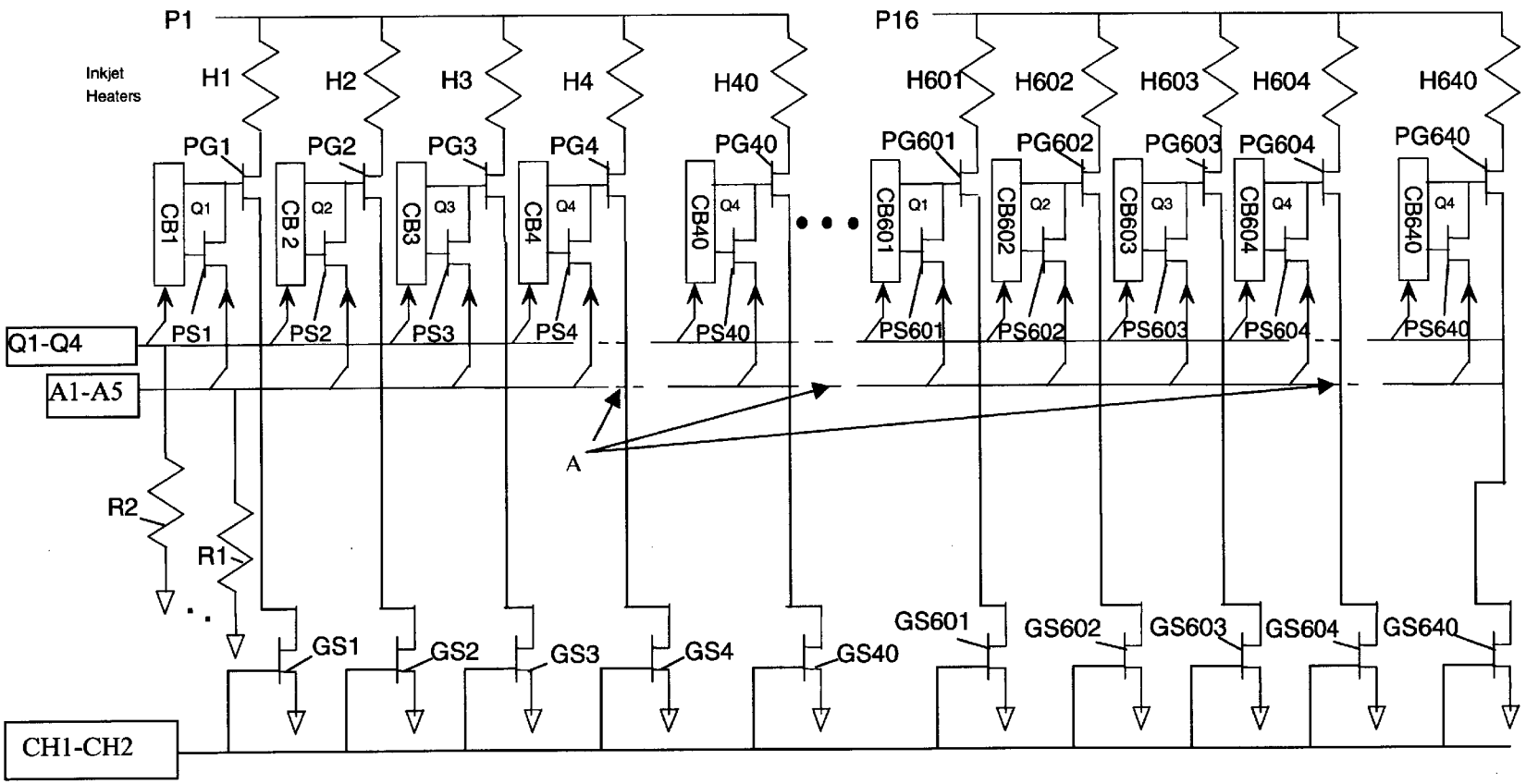
FIG. 2 is a schematic drawing depicting an aspect of a preferred embodiment of a control circuit for an inkjet printhead.

Referring now generally to FIGS. 1 and 2, an integrated control circuit 10 is located on a heater chip 12 of a printhead 14. In the preferred embodiment, a tape automated bonding (TAB) circuit 16 contains the chip 12. The integrated circuit 10 on the chip 12 includes an array of resistive heating elements (hereinafter referred to as heaters) H1–H640 and associated enabling circuitry, as discussed in detail below.

According to one aspect of the invention, FIG. 2 schematically depicts a portion of an enabling circuit for controlling the operation of the printhead 14. The circuitry as depicted in the Figures is a preferred embodiment, and it is appreciated that the circuit elements may be arranged in various other configurations depending upon the particular printing operation desired.

The enabling circuitry includes a number of transistors or switching devices, herein referred to as pass gate devices, also referred herein as pass switching devices, PS1–PS640, power gate devices, also referred to herein as power switching devices, PG1–PG640, and ground gate devices, also referred herein as ground switching devices GS1–GS640. Also shown in FIG. 2 are a number of control blocks, delineated as CB1–CB640.

Figure 3:
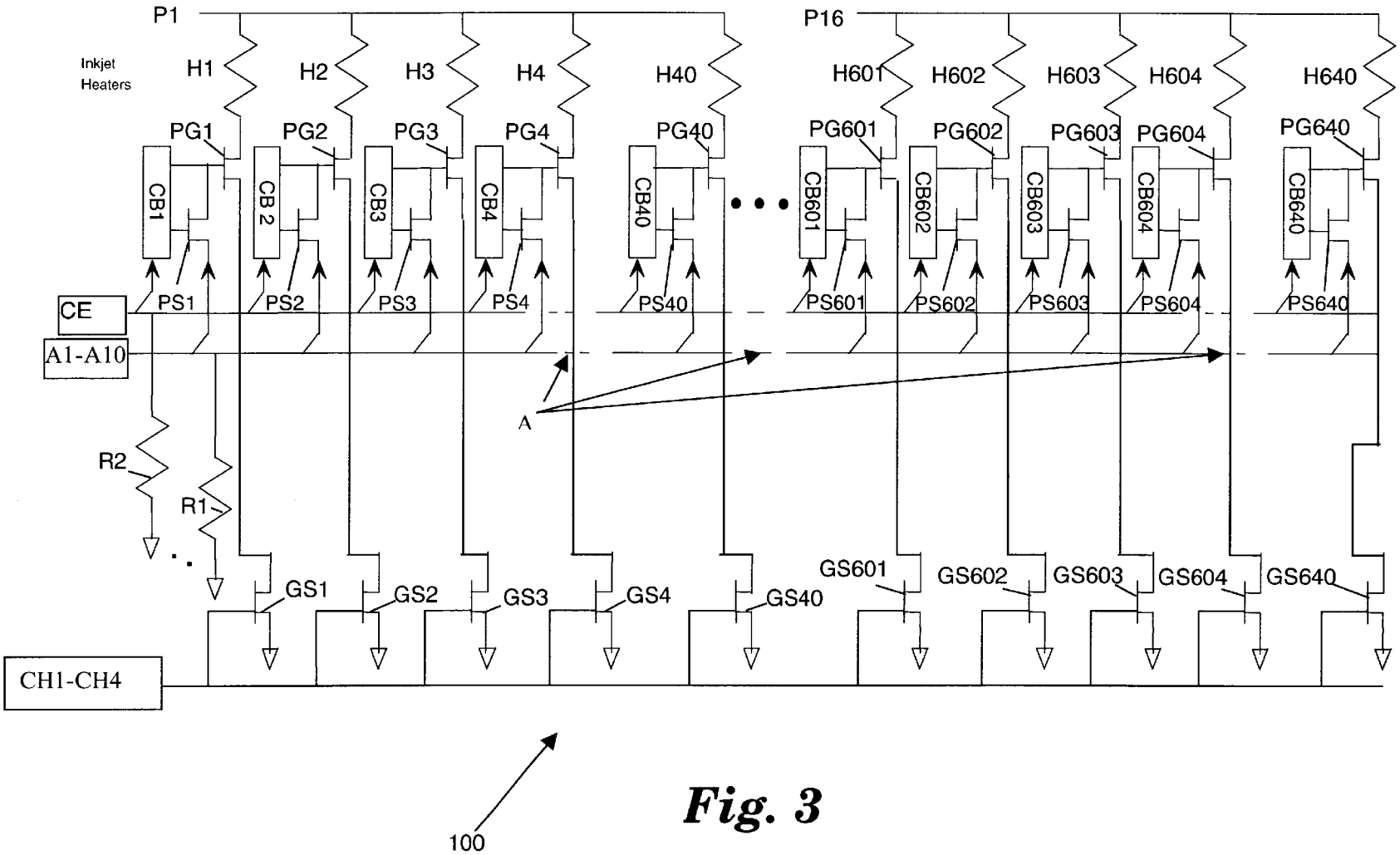
FIG. 3 is a schematic drawing depicting another aspect of a preferred embodiment of a control circuit for an inkjet printhead.
Figure 4:
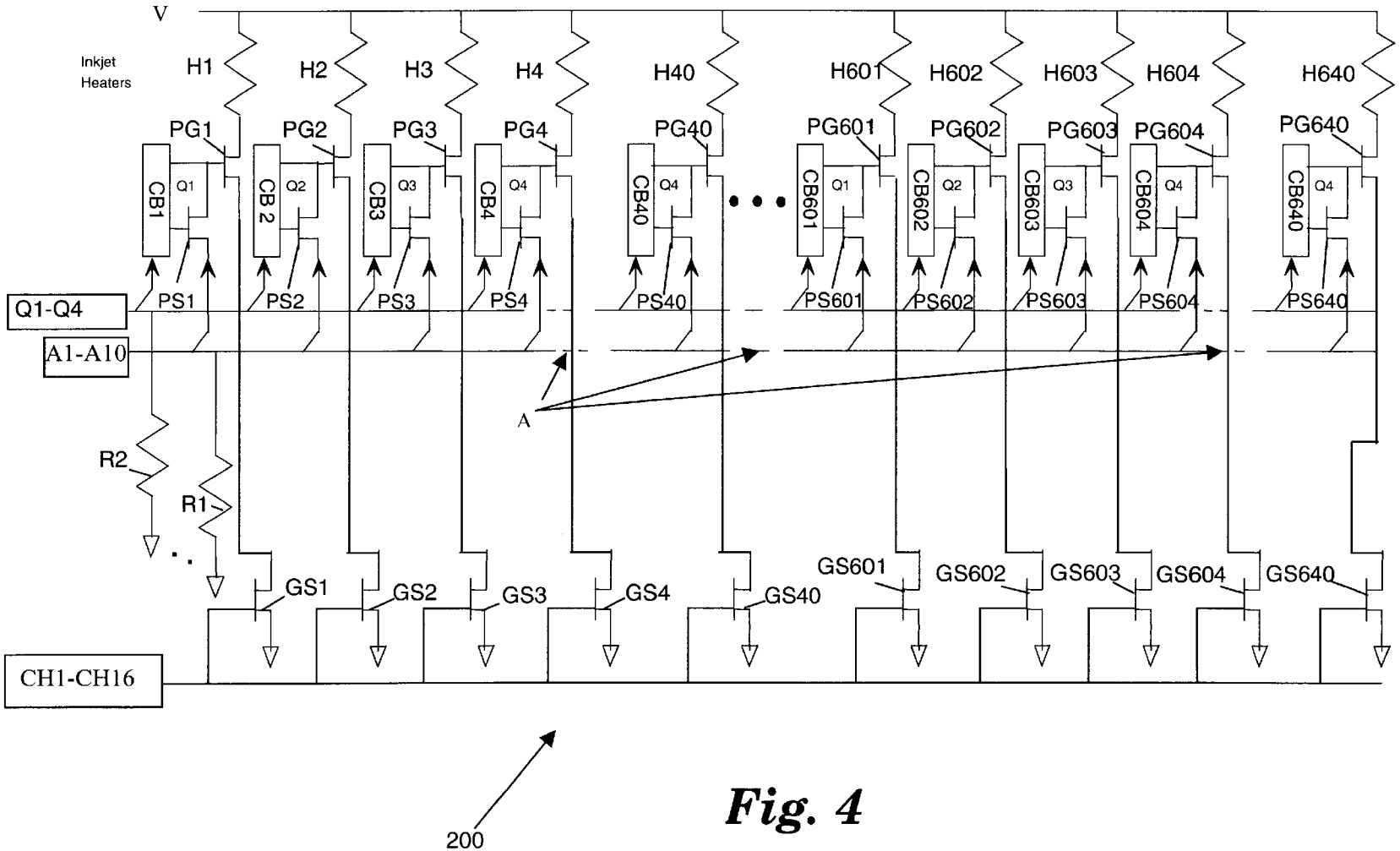
FIG. 4 is a schematic drawing depicting yet another aspect of a control circuit for an inkjet printhead.

Each control block, CB1–CB640, includes control circuitry, preferably pull-down and selection circuits, for providing additional control functions, as discussed further below. Pull-down resistors R1 and R2 provide selective ground paths for pass switching devices, power switching devices, and control blocks of the control circuit 10. FIGS. 2–4 depict a portion of the entire integrated control circuit 10, and each figure includes continuation designators, generally shown as dashed connectors and labeled in the figures as "A", indicating that the circuit includes other circuit components in a similar pattern as that depicted.

The integrated circuit 10 communicates with the printer controller 11 through a number of control lines. As will be appreciated to those skilled in the art, the printer controller 11 receives print information from a host, such as a host computer or the like, and provides one or more control signals to control printing operations based in part on the transmitted print information.

For this aspect of the invention, the control lines preferably include five address lines A1–A5, four quadrature or quad lines Q1–Q4, two heater select lines CH1–CH2, and sixteen primitive control lines P1–P16. The TAB circuit 16 electrically connects the control lines Q1–Q4, A1–A5, and P1–P16 to a number of TAB contacts 18 located on the TAB circuit 16. A number of conductors, which lie generally within the dashed outline area 20 of FIG. 1, electrically connect the TAB circuit contacts 18 with the integrated control circuitry 10 located on the chip 12.

The pass switching devices PS1–PS640, power switching devices PG1–PG640, ground switching devices GS1–GS640, and control block circuits CB1–CB640, perform switching and control operations based on signals provided from the printer controller 11, as discussed in more detail below. Each heater H1–H640 is associated with a corresponding inkjet nozzle 22 in a printhead nozzle plate. Preferably the heaters H1–H640 are thin film metal resistors having resistances of between about 15 ohms to about 50 ohms.

According to the preferred embodiment of the invention, a four dimensional printhead drive scheme utilizes the integrated control circuit 10 contained on the ink jet printhead 14 to generate a printed image on a print medium. As shown in FIG. 2, the integrated control circuit 10 includes six hundred forty (640) heaters H1–H640. Based on the image data input to the printer controller 11, the controller 11 selectively controls the activation of the heaters H1–H640. Once a heater H1–H640 is activated, ink adjacent to the heater H1–H640 is energized and expelled via the associated ink jet nozzles 22 onto a print medium, such as printer paper, thereby printing the desired image.

As described above, the ink jet printer prints an image based on image data input to the printer controller 11 which, in turn, transmits a plurality of control signals to the integrated control circuit 10 located on the printhead 14. First, second, third, and fourth control signals, also referred herein as address, quadrature, primitive, and select/enable digital signals, respectively, delineate how the integrated control circuit 10 functions to control the output of the printhead 14. Preferably, as shown in FIG. 2, the printer controller 11 is electrically connected to and sends the digital signals across four quadrature lines Q1–Q4, five address lines A1–A5, two heater select lines CH1–CH2, and sixteen primitive lines P1–P16 (totaling twenty-seven input/output control lines (4+5+2+16=27)) to the integrated circuit 10 located on the printhead 14, accounting for an addressing scheme capable of activating an array of six hundred forty (4×5×2×16=640) heaters.

Preferably, the circuit 10 includes six hundred forty (640) power switching devices PG1–PG640, each electrically connected to a corresponding one of the heaters H1–H640, pass switching devices PS1–PS640, and one or more ground switching devices GS1–GS640. The pass switching devices PS1–PS640, power switching devices PG1–PG640, and ground switching devices GS1–GS640 are preferably transistors, each having source, drain, and gate connections. It will be appreciated that a number of different transistor types are available and the invention is not intended to be limited by any specific examples and illustrations provided herein.

As shown in FIG. 2, the drain of each power switching device PG1–PG640 is electrically connected to the low side of an associated heater H1–H640. For this aspect of the control circuit 10, the source of each power switching device PG1–PG640 is electrically connected to a drain of a corresponding ground switching device GS1–GS640. The gate of each power switching device PG1–PG640 is electrically connected to a drain of an associated one of the pass switching devices PS1–PS640 and to a first output of an associated one of the control blocks CB1–CB640.

The gate of each pass switching device PS1–PS640 is electrically connected to a second output of an associated one of the control blocks CB1–CB640 (FIG. 2). As shown in FIG. 2, a quad line Q1–Q4 is electrically connected to an input of a corresponding control block CB1–CB640, electrically coupling corresponding pass and power gates associated with the control blocks CB1–CB640. The source of each pass switching device PS1–PS640 is electrically connected to an associated address line A1–A5 and to a pull-down resistor R1 which is electrically connected to ground. Each control block CB1–CB640 includes an input electrically connected to an associated quad line Q1–Q4. As shown in FIG. 2, each control block input is electrically connected to a pull-down resistor R2 which is electrically connected to ground.

With continuing reference to FIG. 2, the source of each ground switching device GS1–GS640 is electrically connected to ground. The gate of each ground switching device GS1–GS640 is electrically connected to an associated heater select line CH1–CH2. As described above, the drain of each ground switching device GS1–GS640 is electrically connected to a corresponding source of a power switching device PG1–PG640. The high side of each of the heaters H1–H640 is electrically connected to an associated primitive select line P1–P16. For this aspect, the printer controller 11 controls the printhead's printing operations by transmitting various control signals across the various control lines: quadrature Q1–Q4, address A1–A5, primitive P1–P16, and heater select CH1–CH2 to selectively effect printing operations based on the above-described control circuit architecture. Thus, the printing operations are controlled according to a four-dimensional control scheme.

When it is desired to print an image, the host, typically a host computer, transmits the image data to the controller 11. The printer controller 11, based on the received image data, controls the integrated control circuit 10 by transmitting the above-described control signals to control the operation of the printhead 14. As shown in FIG. 2, each primitive line P1–P16 electrically connects to an associated group of forty (40) resistive heaters, i.e., P1:H1–H40, P2:H41–H80, P3:H81–H120, P4:H121–H160, P5:H161–H200, P6:H201–H240, P7:H241–H280, P8:H281–H320, P9:H321–H360, P10:H361–H400, P11:H401–H440, P12:H441–H480, P13:H481–H520, P14:H521–H560, P15:H561–H600, and P16:H601–H640.

Within each group of forty heaters, an associated quad line Q1–Q4 electrically connects to an associated subset of heaters H1–H640. As shown in FIG. 2, for the first group of heaters H1–H40, quad line Q1 electrically connects to heaters H1, H5, H9, H13, H17, H21, H25, H29, H33, and H37, herein termed a subset of the larger group of heaters H1–H40. Similarly, for the first group of heaters H1–H40, quad line Q2 electrically connects to heaters H2, H6, H10, H14, H18, H22, H26, H30, H34, and H38, and likewise for quad lines Q3 and Q4, and continuing in a similar manner for the remaining heater groups.

Within each subset of each group, the address lines A1–A5, and heater select lines CH1–CH2 control the activation of specific heaters according to control signals provided by the printer controller 11. For example, suppose the printing operation requires the activation of a select number of heaters associated with primitive line P1, i.e. group H1–H40. To enable the group, the printer controller 11 transmits a control signal causing primitive line P1 to have a high state. The printer controller 11 transmits control signals across select quad lines, address lines, and heater select lines to activate heaters within this group.

Continuing with this example, to activate heater H1, the printer controller 11 transmits control signals causing high states on quad line Q1, address line A1, and heater select line CH1, thereby activating heater H1 and energizing the adjacently disposed ink. It is appreciated that different combinations and permutations exist for applying the various control signals and the invention is not intended to be limited by any specific examples described herein. Utilizing this four dimensional addressing scheme, the printer controller 11 selectively enables the printhead 14 to vary the nozzle output to print a desired image.

Referring to Table 1 below, a preferred embodiment of a four dimensional addressing scheme is shown. Table 1 illustrates the preferred addressing scheme for selectively enabling the activation of the heaters associated with primitive lines P1 and P16, and thereby selectively energizing the ink adjacent to the heaters associated therewith. Primitive lines P2–P15 follow a similar addressing scheme. Most preferably, the addressing scheme is operable to fire the heaters H1–H640 to achieve maximum nozzle-to-nozzle separation between firings.

The printer controller 11 is operable to cause all or just a portion of the signals transmitted across the sixteen primitive control lines P1–P16 to have a high state by sending a corresponding primitive signal to the printhead 14. For example, during a predetermined print interval, one to sixteen primitive control signals may have a high state, depending upon the image data input to the printer controller 11. Utilizing the four dimensional addressing scheme, the printer controller 11 selectively enables the printhead 14 to vary the nozzle output, from one to sixteen nozzles, based upon the number of high primitive signals transmitted across primitive lines P1–P16.

Preferably, the heaters H1–H640 are arrayed in p number of groups based on p number of primitive lines, and q number of subsets within each group based on q number of quad lines. The a number of address lines and h number of heater control lines operate to activate one or more specific heaters within each subset. For this aspect of the control circuit 10, it is preferred that there are sixteen groups of forty heaters (p=16), wherein each subset of each group includes ten heaters, each subset corresponding to the number of quad lines Q1–Q4 (q=4).

During a given printing operation, one to sixteen primitive lines have a high state during a specific printing interval to activate one or more heater groups. At the same time, one of the four quad lines, according to control signals provided by the controller 11, have a high state to activate a particular subset of a heater group. Address lines A1–A5, and heater select lines CH1–CH2 activate selected heaters within each subset of each group.

For example, and referring again to Table 1, to activate heaters H1 and H601, the printer controller 11 transmits primitive signals across primitive lines P1 and P116, selecting the groups of heaters H1–H40 and H601–H640. The printer controller 11 sends control signals across quad line Q1, address line A1 and heater select line CH1, causing high states on the respective lines and thereby activating heaters H1 and H601 to discharge ink from the corresponding nozzles.

More particularly and referring again to FIG. 2, activating primitive lines P1 and P16 results in the high sides of heaters H1–H40 and H601–H640 having high states corresponding to the primitive control signals transmitted across primitive lines P1 and P16. Activating quad line Q1 transmits a high quad signal across quad line Q1, resulting in a high state at the gates of pass switching devices PS1 and PS601, thereby activating the pass switching devices PS1 and PS601.

According to this aspect of the control circuit, to discharge ink from nozzles corresponding to heaters H1 and H601, the printer controller 11 transmits a control signal across address line A1, causing a high state on each source of the pass switching devices PS1 and PS601, effecting high states on the gates of power switching devices PG1 and PG601. The printer controller 11 also transmits a control signal across heater select line CH1 causing a high state on each gate of ground switching devices GS1 and GS601, activating ground switching devices GS1 and GS601, and connecting the activated power switching devices PG1 and PG601 to ground, thereby firing heaters H1 and H601.

Thus, the ground switching devices GS1–GS640 provide an additional control dimension, selectively providing a ground path for corresponding power switching devices PG1–PG640, according to the signals transmitted across heater select lines CH1 and CH2. According to this example of the four dimensional addressing scheme, transmitting high control signals across lines P1, P16, Q1, A1, and CH1 activates switches PG1, PG601, PS1, PS601, GS1, and GS601, energizing the ink adjacent to heaters H1 and H601 and thereby ejecting ink from the corresponding nozzles onto the print medium.

Figure 5:
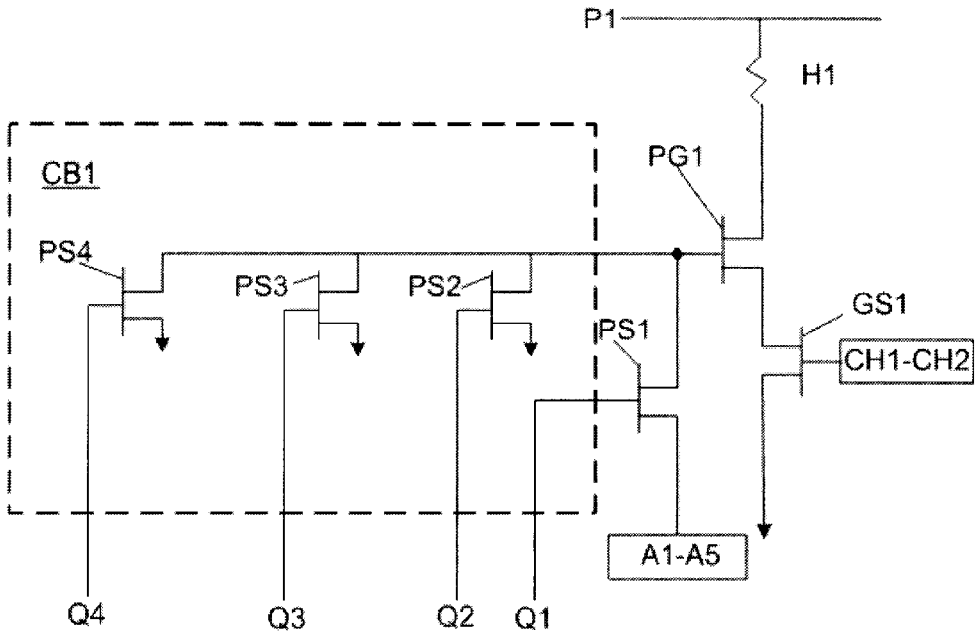
FIGS. 5 and 6 are schematic drawings depicting control blocks and operation thereof for an aspect of a control circuit for an inkjet printhead according to the invention.
Figure 6:
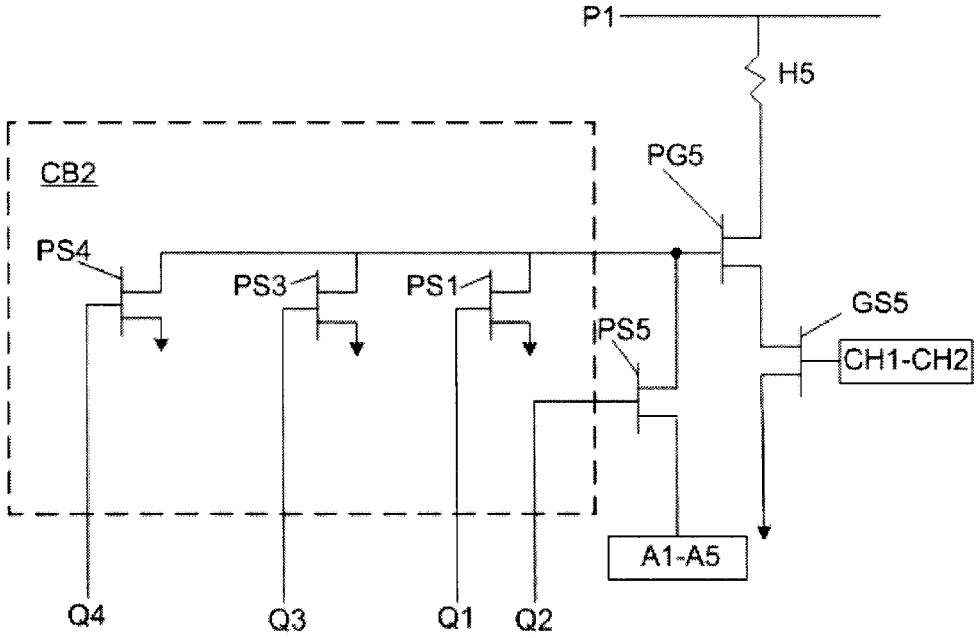

Operation of the control blocks CB1–CB640 are illustrated in FIGS. 5 and 6. The control blocks CB1–CB640 provide a pull down circuit to enable only one of the power switching devices PS1–PS4 to be on at a time when the corresponding quad line input Q1–Q4 is active. Only one quad line input Q1–Q4 is active at a time. Hence, in FIG. 5, when quad input Q1 is active, pass switching device PS1, power switching device PG1, and ground switching device GS1 activate heater H1. In FIG. 6, quad input Q2 is active, thus pass switching device PS5, power switching device PG5, and ground switching device GS5 activate heater H5. The operation of control blocks CB3–CB640 operate the same as illustrated in FIGS. 5 and 6 for the remaining pass switching devices, power switching devices, ground switching devices and heaters. Only one quad input Q1–Q4 is active at a time.

TABLE 1

| | | | P1 | . . . | P16 |
|---|---|---|---|---|---|
| CH1 | Q1 | A1 | H1 | | H601 |
| | | A2 | H15 | | H615 |
| | | A3 | H28 | | H628 |
| | | A4 | H3 | | H603 |
| | | A5 | H17 | | H617 |
| | Q2 | A1 | H30 | | H630 |
| | | A2 | H5 | | H605 |
| | | A3 | H19 | | H619 |
| | | A4 | H32 | | H632 |
| | | A5 | H7 | | H607 |
| | Q3 | A1 | H21 | | H621 |
| | | A2 | H34 | | H634 |
| | | A3 | H9 | | H609 |
| | | A4 | H23 | | H623 |
| | | A5 | H36 | | H636 |
| | Q4 | A1 | H11 | | H611 |
| | | A2 | H25 | | H625 |
| | | A3 | H38 | | H638 |
| | | A4 | H13 | | H613 |
| | | A5 | H40 | | H640 |
| CH2 | Q1 | A1 | H2 | | H602 |
| | | A2 | H16 | | H616 |
| | | A3 | H29 | | H629 |
| | | A4 | H4 | | H604 |
| | | A5 | H18 | | H618 |
| | Q2 | A1 | H31 | | H631 |
| | | A2 | H6 | | H606 |
| | | A3 | H20 | | H620 |
| | | A4 | H33 | | H633 |
| | | A5 | H8 | | H608 |
| | Q3 | A1 | H22 | | H622 |
| | | A2 | H35 | | H635 |

TABLE 1-continued

| | | | P1 | . . . | P16 |
|---|---|---|---|---|---|
| | | A3 | H10 | | H610 |
| | | A4 | H24 | | H624 |
| | | A5 | H37 | | H637 |
| | Q4 | A1 | H12 | | H612 |
| | | A2 | H26 | | H626 |
| | | A3 | H39 | | H639 |
| | | A4 | H14 | | H614 |
| | | A5 | H27 | | H627 |

As shown in Table 1, and according to this aspect of the four dimensional addressing scheme, for each primitive line P1–P16, there are twenty heaters controlled by heater select lines CH1 and CH2.

Referring now to FIG. 3, an alternative embodiment of a control circuit 100 for controlling the operation of a printhead 14 is shown. In this embodiment, the control circuit 100 includes a number of control lines: preferably sixteen primitive lines P1–P16, ten address lines A1–A10, one enable line CE, and four heater select lines CH1–CH4, all electrically connected to the printer controller 11. For this aspect, the heaters H1–H640, power switching devices PG1–PG640, pass switching devices PS1–PS640, and gate switching devices GS1–GS640 have substantially the same electrical configuration as described above for the first embodiment of the control circuit 10, and therefore the description is not repeated here.

As shown in FIG. 3, the printer controller 11 controls the printhead's printing operations by transmitting select control signals across the various control lines: enable CE, the ten address lines A1–A10, the sixteen primitive P1–P16, and the four heater select lines CH1–CH4 (1+10+16+4=31 input/output lines), accounting for an addressing scheme capable of activating an array of six hundred forty (1×10×16×4=640) heaters H1–H640. Thus, the printing operations of this embodiment are also controlled according to a four-dimensional control scheme.

For example, to activate heater H1, thereby energizing the adjacently disposed ink, the printer controller 11 sends control signals across primitive line P1, address line A1, enable line CE, and heater select line CH1. For this aspect of the control circuit 10, it is preferred that there are sixteen groups of forty heaters, wherein each subset of each group includes ten heaters, each subset corresponding to the number of heater select lines CH1–CH4. During a given printing operation, one to sixteen primitive lines have a high state during a specific printing interval to activate one or more heater groups. At the same time, one of the four heater select lines, according to control signals provided by the controller 11, have a high state to activate a particular subset of a heater group. Address lines A1–A10, and the enable select line CE activate selected heaters within each subset of each group.

For example, to activate heater H1, the printer controller 11 transmits a primitive signal across primitive line P1, selecting the group of heaters H1–H40. The printer controller 11 sends control signals across heater select line CH1, address line A1 and enable line CE, causing high states on the respective lines, thereby activating heater H1 to discharge ink from the corresponding nozzle.

More particularly, activating primitive line P1 results in the high sides of heaters H1–H40 having high states corresponding to the primitive control signal transmitted across primitive line P1. The controller 11 activates the enable line CE, transmitting a high enable signal across the enable line CE, resulting in a high state at the gate of pass switching device PS1, thereby activating the pass switching device PS1.

According to this aspect of the control circuit 100, to discharge ink from the nozzle corresponding to heater H1, the printer controller 11 transmits a control signal across address line A1, causing a high state on the source of the pass switching device PS1, effecting a high state on the gate of power switching device PG1. The printer controller 11 also transmits a control signal across heater select line CH1 causing a high state on the gate of ground switching device GS1, to thereby activate ground switching device GS1, connecting the activated power switching device PG1 to ground, thereby firing heaters H1 and H601.

Thus, the ground switching devices GS1–GS640 provide an additional control dimension, selectively providing a ground path for corresponding power switching devices PG1–PG640, according to signals transmitted across heater select lines CH1–CH4. According to this example of the four dimensional addressing scheme, transmitting high control signals across lines P1, CE, A1, and CH1 activates switches PG1, PS1, and GS1, energizing the ink adjacent to heater H1, thereby ejecting ink from the corresponding nozzle onto the print medium.

Referring now to FIG. 4, yet another alternative embodiment of a control circuit 200 for controlling the operation of a printhead 14 is shown. In this embodiment, the control circuit 200 includes a number of control lines: preferably a single voltage line V, ten address lines A1–A10, four quad lines Q1–Q4, and sixteen heater select lines CH1–CH16, all of the control lines electrically connected to the printer controller 11. For this aspect, the heaters H1–H640, power switching devices PG1–PG640, pass switching devices PS1–PS640, and gate switching devices GS1–GS640 have substantially the same electrical configuration as described above in the first embodiment of the control circuit 10, and therefore the description is not repeated here.

As shown in FIG. 4, the printer controller 11 controls the printhead's printing operations by transmitting select control signals across the various control lines: fixed voltage line V, ten address lines A1–A10, four quad lines Q1–Q4, and sixteen heater select lines CH1–CH16 (1+10+4+16=31 input/output lines), accounting for an addressing scheme capable of activating an array of six hundred forty (1×10×4×16=640) heaters H1–H640. Thus, the printing operations of this embodiment are controlled according to yet another four-dimensional control scheme.

For example and with continuing reference to FIG. 4, to activate heater H1, thereby energizing the adjacently disposed ink, the printer controller 11 sends control signals across the voltage line V address line A1, quad line Q1, and heater select line CH1. For this aspect of the control circuit 200, it is preferred that there are sixteen groups of forty heaters, wherein each subset of each group includes ten heaters, each subset corresponding to the number of quad lines Q1–Q4. During a given printing operation, all of the heater groups are selectable when the fixed voltage line V has a high state. This fixed voltage line aspect also allows one or more printhead chips in the printhead 14 to be selectively enabled or disabled.

The heater select lines CH1–CH 16 have a high state during a specific printing interval to activate a select heater group. At the same time, one of the four quad lines Q1–Q4, according to control signals provided by the controller 11, have a high state to activate a particular subset of a heater group. Control signals provided across address lines A1–A10, activate select heaters within each subset of each group.

It is contemplated, and will be apparent to those skilled in the art from the preceding description and the accompanying drawings that modifications and/or changes may be made in the embodiments of the invention. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. A method of activating a printing element within an array of printing elements on a printhead of an inkjet printer comprising:

(a) providing a plurality of printing elements, (b) providing a plurality of power switching devices coupled to the plurality of printing elements, each power switching device having a power source, power drain, and power gate, (c) providing a plurality of pass switching devices, each pass switching device coupled to a corresponding power switching device, each pass switching device having a pass source, pass drain, and a pass gate, (d) providing one or more ground switching devices, the one or more ground switching devices having a ground source, ground drain, and ground gate, where the pass drain of each pass switching device is connected to the power gate of a corresponding one of the power switching devices, where a ground drain of the one or more one ground switching devices is coupled to one or more power sources of one or more of the power switching devices, and where the power drain of each power switching device is connected to a corresponding one of the printing elements, (e) defining a plurality of groups of printing elements and associated pass switching and power switching devices, (f) within each group defining a plurality of subsets of printing elements and associated pass switching devices, (g) providing a subset selection signal to the pass switching devices and power switching devices of a selected one of the subsets to thereby select a subset of printing elements in the array of printing elements based on the subset selection signal, (h) providing an address signal to a selected subset of the pass switching devices to thereby select a one or more printing elements based on the address signal, (i) providing a heater select signal to one or more of the ground switching devices, (j) providing a primitive signal to a select one of the groups of printing elements on the printhead, and (k) activating a selected printing element within the select group based on the primitive signal and the heater select signal.

2. The method of claim 1, wherein:

step (g) includes providing the subset selection signal to the pass and power gates of the pass switching devices and power switching devices within the subset and setting the subset selection signal high on the pass and power gates of the pass switching devices and power switching devices within the subset.

3. The method of claim 1, wherein:

step (h) includes providing the address signal to the pass sources of the pass switching devices within the selected subset and setting the address signal high on the pass sources of the pass switching devices within the selected subset.

4. The method of claim 1, wherein:

step (i) includes providing the heater select signal to one or more gates of the one or more of the ground switching devices and setting the heater select signal high on the one or more gates of the ground switching devices, and step (j) includes setting the primitive signal high on the printing element.

5. An integrated circuit for controlling a printing operation of an inkjet printhead based on first, second, third, and fourth control signals provided by a printer controller, the integrated circuit comprising:

a plurality of printing elements arranged in selectable groups for printing an image on a print medium, a plurality of power switching devices, each coupled to a corresponding one of the printing elements, a plurality of pass switching devices, each coupled to a corresponding one of the power switching devices, one or more ground switching devices coupled to one or more of the power switching devices, p number of first control lines each coupled to a corresponding one of the selectable groups of printing elements, each first control line for providing the first control signal to one or more of the selectable groups of printing elements, thereby selectively enabling activation of one or more of the selectable groups of the printing elements, q number of second control lines each coupled to a corresponding selectable subset of power switching devices and pass switching devices within one or more of the selectable groups of printing elements, each second control line for providing the second control signal to the corresponding selectable subset of power switching devices and pass switching devices, the second control lines for selectively enabling activation of the corresponding subset of power switching devices and pass switching devices within the one or more selectable groups, a number of third control lines, each coupled to corresponding pass switching devices within each subset of printing elements, the third control lines for providing the third control signal to the corresponding selectable subset of pass switching devices, the third control signal for selectively enabling activation of one of the printing elements within the corresponding selectable subset, and h number of fourth control lines coupled to the one or more of the ground switching devices, the fourth control lines for providing the fourth control signal to the one or more ground switching devices, the fourth control signal for selectively activating the one or more of the ground switching devices to connect the one or more power switching devices to ground, thereby activating a selected printing element within the selected subset of printing elements.

6. The integrated circuit of claim 5 further comprising:

each pass switching device having a pass gate, pass source, and pass drain, each power switching device having a power gate, power source, and power drain, and the one or more ground switching devices each having a ground gate, ground source, and ground drain.

7. The integrated circuit of claim 6 further comprising:

a plurality of control switching circuits corresponding to the plurality of pass switching devices and power switching devices, each control switching circuit having an input and first and second outputs, the input of each control switching circuit electrically connected to a corresponding one of the second control lines, the pass gate of each pass switching device electrically connected to the first output of the control switching circuit, the pass drain of each pass switching device electrically connected to a power gate of a corresponding one of the power switching devices, the pass source of each pass switching device electrically connected to a corresponding one of the third control lines, the power gate of each power switching device electrically connected to the second output of the control switching circuit, the power drain of each power switching device electrically connected to one side of a corresponding printing element, the power source of each power switching device electrically connected to the ground drain of a corresponding ground switching device, each ground gate of the one or more ground switching devices electrically connected to a corresponding one of the fourth control lines, and each ground source of the one or more ground switching devices electrically connected to ground.

8. The integrated circuit of claim 7 further comprising:

the control switching circuit for providing the second control signal to the pass gate of each pass switching device, each pass switching device for providing the second control signal to a power gate of a corresponding one of the power switching devices, thereby selectively activating the power gate of each power switching device.

9. The integrated circuit of claim 5 further comprising a one to one correspondence between the ground and power switching devices.

10. The integrated circuit of claim 5 further comprising one ground switching device electrically connected to each power switching device.

11. The integrated circuit of claim 5, wherein p equals sixteen, q equals four, a equals five, and h equals 2, corresponding to an addressing arrangement capable of selectively activating six-hundred and forty printing elements.

12. The integrated circuit of claim 5, wherein p equals sixteen, q equals one, a equals ten, and h equals 4, corresponding to an addressing arrangement capable of selectively activating six-hundred and forty printing elements.

13. The integrated circuit of claim 5, wherein p equals one, q equals four, a equals ten, and h equals sixteen, corresponding to an addressing arrangement capable of selectively activating six-hundred and forty printing elements.

14. An ink jet printer comprising:

a printer controller for generating print signals, a printhead for generating a printed image on a print medium, the printhead including:

a plurality of printing elements arranged in selectable groups for printing the image on the print medium, a plurality of power switching devices, each coupled to a corresponding one of the printing elements, a plurality of pass switching devices, each coupled to a corresponding one of the power switching devices, one or more ground switching devices coupled to one or more of the power switching devices, p number of first control lines each coupled to a corresponding one of the selectable groups of printing elements, each first control line for providing the first control signal to one or more of the selectable groups of printing elements, thereby selectively enabling activation of one or more of the selectable groups of the printing elements, q number of second control lines each coupled to a corresponding selectable subset of power switching devices and pass switching devices within one or more of the selectable groups of printing elements, each second control line for providing the second control signal to the corresponding selectable subset of power switching devices and pass switching devices, the second control lines for selectively enabling activation of the corresponding subset of power switching devices and pass switching devices within the one or more selectable groups, a number of third control lines, each coupled to corresponding pass switching devices within each subset of printing elements, the third control lines for providing the third control signal to the corresponding selectable subset of pass switching devices, the third control signal for selectively enabling activation of one of the printing elements within the corresponding selectable subset, and h number of fourth control lines coupled to the one or more of the ground switching devices, the fourth control lines for providing the fourth control signal to the one or more ground switching devices, the fourth control signal for selectively activating the one or more of the ground switching devices to connect the one or more power switching devices to ground, thereby activating a selected printing element within the selected subset of printing elements.

15. The printer of claim 14, wherein the printhead further comprises:

each pass switching device having a pass gate, pass source, and pass drain, each power switching device having a power gate, power source, and power drain, and the one or more ground switching devices each having a ground gate, ground source, and ground drain.

16. The printer of claim 15, wherein the printhead circuit further comprises:

a plurality of control switching circuits corresponding to the plurality of pass switching devices and power switching devices, each control switching circuit having an input and first and second outputs, the input of each control switching circuit electrically connected to a corresponding one of the second control lines, the pass gate of each pass switching device electrically connected to the first output of the control switching circuit, the pass drain of each pass switching device electrically connected to a power gate of a corresponding one of the power switching device, the pass source of each pass switching device electrically connected to a corresponding one of the third control lines, the power gate of each power switching device electrically connected to the second output of the control switching circuit, the power drain of each power switching device electrically connected to one side of a corresponding printing element, the power source of each power switching device electrically connected to the ground drain of a corresponding ground switching device, each ground gate of the one or more ground switching devices electrically connected to a corresponding one of the fourth control lines, and each ground source of the one or more ground switching devices electrically connected to ground.

17. The printer of claim 16, wherein the printhead further comprises:

the control switching circuit for providing the second control signal to the pass gate of each pass switching device, each pass switching device for providing the second control signal to a power gate of a corresponding one of the power switching devices, thereby selectively activating the power gate of each power switching device.

18. The printer of claim 14, wherein p equals sixteen, q equals four, a equals five, and h equals 2, corresponding to an addressing arrangement capable of selectively activating six-hundred and forty printing elements.

19. The printer of claim 14, wherein p equals sixteen, q equals one, a equals ten, and h equals 4, corresponding to an addressing arrangement capable of selectively activating six-hundred and forty printing elements.

20. The printer of claim 14, wherein p equals one, q equals four, a equals ten, and h equals sixteen, corresponding to an addressing arrangement capable of selectively activating six-hundred and forty printing elements.

* * * * *